United States Patent [19]

Morton

[11] 4,102,737

[45] Jul. 25, 1978

[54] PROCESS AND APPARATUS FOR FORMING A PAPER WEB HAVING IMPROVED BULK AND ABSORPTIVE CAPACITY

[75] Inventor: Wendell J. Morton, Cincinnati, Ohio

[73] Assignee: The Procter & Gamble Company, Cincinnati, Ohio

[21] Appl. No.: 797,281

[22] Filed: May 16, 1977

[51] Int. Cl.[2] ..... D21F 9/02; D21H 5/02; D21H 5/06

[52] U.S. Cl. ..... 162/113; 162/203; 162/207; 162/290; 162/301; 162/307; 162/359

[58] Field of Search ..... 162/111, 113, 115, 116, 162/203, 206, 207, 281, 290, 296, 297, 301, 305, 307, 359, DIG. 1, 214, 317, 344

[56] References Cited

U.S. PATENT DOCUMENTS

| | | | |
|---|---|---|---|
| 3,224,928 | 12/1961 | Lee et al. | 162/203 X |
| 3,301,746 | 1/1967 | Sanford et al. | 162/113 |
| 3,373,080 | 3/1968 | Appel et al. | 162/344 X |
| 3,400,045 | 9/1968 | Graham | 162/214 X |
| 3,434,922 | 3/1969 | Ely | 162/203 X |
| 3,470,063 | 9/1969 | Sanford | 162/214 X |
| 3,537,954 | 11/1970 | Justus | 162/113 X |
| 3,745,066 | 7/1973 | Bleuer | 162/203 X |
| 3,994,771 | 11/1976 | Morgan, Jr. et al. | 162/113 |
| 4,055,461 | 10/1977 | Turunen | 162/290 |

*Primary Examiner*—Richard V. Fisher
*Attorney, Agent, or Firm*—E. Kelly Linman; John V. Gorman; Richard C. Witte

[57] ABSTRACT

An improved low-density papermaking process particularly suited for use in conjunction with twin wire formation style papermaking machines is disclosed. In a particularly preferred embodiment, a foraminous drying-/imprinting fabric conventionally utilized to thermally predry a moist paper web is extended to the twin wire formation zone, thereby eliminating one of the conventionally utilized Fourdrinier wire sections. Extension of the drying/imprinting fabric to the formation zone eliminates disturbance of the deflected portions of the paper web which fill the interstices of the drying/imprinting fabric during formation of the web, thus producing unexpected improvements in finished product bulk and absorptive capacity.

15 Claims, 3 Drawing Figures

PROCESS AND APPARATUS FOR FORMING A PAPER WEB HAVING IMPROVED BULK AND ABSORPTIVE CAPACITY

FIELD OF THE INVENTION

The present invention relates to improvements in wet laid and non-woven web manufacturing operations, especially those utilized for producing soft, bulky, and absorbent paper sheets suitable for use in tissue, toweling and sanitary products. In particular, the present invention relates to an improved process for producing said paper sheets on a twin wire formation style papermachine.

BACKGROUND OF THE INVENTION

In the conventional manufacture of paper sheets for use in tissue, toweling and sanitary products, it is customary to perform, prior to drying, one or more overall pressing operations on the entire surface of the paper web as laid down on the Fourdrinier wire or other forming surface. Conventionally, these overall pressing operations involve subjecting a moist paper web supported on a papermaking felt to pressure developed by opposed mechanical members, for example, rolls. Pressing generally accomplishes the triple function of mechanical water expulsion, web surface smoothing and tensile strength development. In most prior art processes, the pressure is applied continuously and uniformly across the entire surface of the felt. Accompanying the increase in tensile strength in such prior art papermaking processes, however, is an increase in stiffness and overall density.

Furthermore, the softness of such conventionally formed, pressed and dried paper webs is reduced not only because their stiffness is increased as a result of increased interfiber hydrogen bonding, but also because their compressibility is decreased as a result of their increased density. Creping has long been employed to produce an action in the paper web which disrupts and breaks many of the interfiber bonds already formed in the web. Chemical treatment of the papermaking fibers to reduce their interfiber bonding capacity has also been employed in prior art papermaking techniques.

A significant advance in producing lower density paper sheets is disclosed in U.S. Pat. No. 3,301,746 which issued to Sanford et al. on Jan. 31, 1967, said patent being hereby incorporated herein by reference. The aforesaid patent discloses a method of making bulky paper sheets by thermally predrying a web to a predetermined fiber consistency while supported on a drying/imprinting fabric and impressing the fabric knuckle pattern in the web prior to final drying. The web is preferably subjected to creping on the dryer drum to produce a paper sheet having a desirable combination of softness, bulk, and absorbency characteristics.

Other papermaking processes which avoid compaction of the entire surface of the web, at least until the web has been thermally predried, are disclosed in U.S. Pat. No. 3,812,000 issued to Salvucci, Jr. et al. on May 21, 1974; U.S. Pat. No. 3,821,068 issued to Shaw on June 28, 1974; U.S. Pat. No. 3,629,056 issued to Forrest on Dec. 21, 1971; and U.S. Pat. No. 3,994,771 issued to Morgan, Jr. et al. on Nov. 30, 1976, the aforesaid patents being hereby incorporated herein by reference.

Twin wire formation style papermachines, which are known to be old in the art, may of course be employed with the low-density papermaking processes generally described in the aforementioned patents. When utilized in conjunction with a process such as that described in the patent to Sanford et al., the prior art practice has been to form a moist fibrous web by depositing a fibrous stock slurry between a pair of converging Fourdrinier wires, partially dewatering the moist fibrous web while it is constrained between the Fourdrinier forming wires, separating the uppermost Fourdrinier wire from the web which remains in contact with the lowermost Fourdrinier wire and thereafter transferring the moist fibrous web by means of fluid pressure from the lowermost Fourdrinier wire to a less dense foraminous drying/imprinting fabric while the web is at relatively low fiber consistency. The web is thereafter processed in accordance with the teachings of the patent to Sanford et al. It has been unexpectedly discovered, however, that both finished product bulk and absorptive capacity can be improved by extending the drying/imprinting fabric to the twin wire formation zone of the papermachine, thereby eliminating completely the uppermost Fourdrinier wire as well as the necessity for subsequently transferring the moist fibrous web from the lowermost Fourdrinier wire to the drying imprinting fabric.

OBJECTS OF THE INVENTION

Accordingly, it is an object of the present invention to provide an improved process for forming a soft, bulky and absorbent paper sheet exhibiting improved bulk and absorptive capacity on a twin wire formation style, low-density papermaking machine.

It is another object of the present invention to provide apparatus for carrying out the aforementioned process.

SUMMARY OF THE INVENTION

In a particularly preferred embodiment of the present invention, a low-density papermaking process for the manufacture of a soft, bulky and absorbent paper sheet having a basis weight between about 5 and about 40 pounds per 3,000 square feet, as measured in an uncreped state, is provided. Briefly, the improved process comprises the steps of:

(a) forming a moist paper web directly between a first traveling foraminous support member and a second traveling foraminous support member having more open interstitital area than said first foraminous support member, said second foraminous support member having between about 100 and 3,600 mesh openings per square inch;

(b) subjecting said moist paper web to a pressure differential on said second traveling foraminous support member while said web is at a sufficiently low fiber consistency to permit partially displacing at least one surface of said web in small discrete deflected areas corresponding to the mesh openings in said second foraminous support member; and (c) drying said sheet to a fiber consistency of at least about 30 percent without disturbing the deflected areas in said web.

BRIEF DESCRIPTION OF THE DRAWINGS

While the specification concludes with claims particularly pointing out and distinctly claiming the subject matter which is regarded as the present invention, it is believed that the invention will be better understood from the following description taken in connection with the accompanying drawings, in which:

DESCRIPTION OF THE PREFERRED EMBODIMENTS

Figure 1:
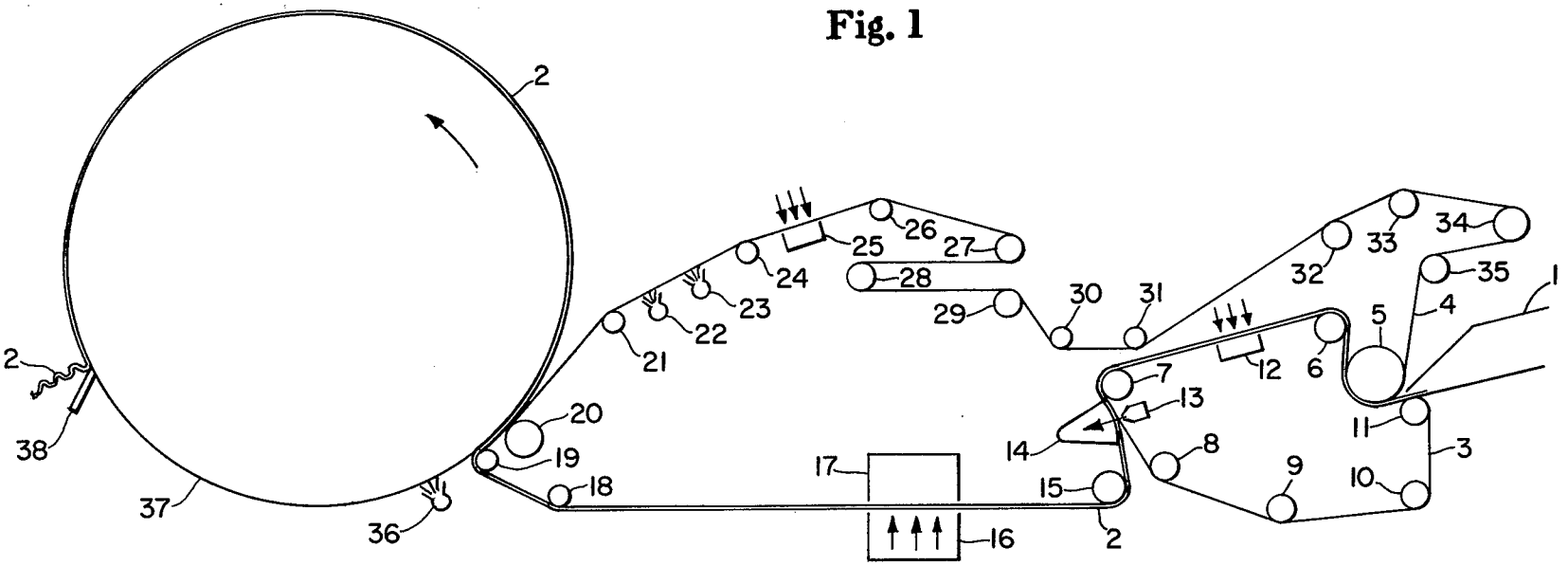
FIG. 1 is a simplified schematic illustration of a twin wire papermaking machine employing a preferred embodiment of the present invention in conjunction with a low-density papermaking process such as that disclosed in the aforementioned patent to Sanford et al.

FIG. 1 shows an example of a twin wire formation style papermaking machine employing a preferred embodiment of the present invention. A papermaking furnish is delivered from a closed headbox 1 intermediate a lowermost Fourdrinier wire and an uppermost foraminous drying/imprinting fabric of the type generally described in the aforementioned patents to Sanford et al. and to Morgan, Jr. et al. which converge with one another about a conventional twin wire forming roll 5. As utilized herein, the term Fourdrinier wire is utilized to designate a foraminous forming surface constructed of any suitable material, i.e., metal wires, plastic monofilaments, etc. A moist paper web 2 is formed intermediate the Fourdrinier wire 3 and the drying/imprinting fabric 4, and the laminate sandwich thereby created passes over direction changing roll 6 and across one or more vacuum boxes 12 to increase the fiber consistency of the web. The laminate sandwich is thereafter directed about a conventional rubber covered couch roll 7 and downwardly to a vacuum pickup shoe 14 mounted against the inside face of the drying/imprinting fabric 4. In a particularly preferred embodiment of the present invention, a compressible fluid nozzle 13 located at the interior surface of the Fourdrinier wire 3 is applied at the interior surface of the Fourdrinier wire opposite the suction box to aid in disengaging the Fourdrinier wire from the moist fibrous web as well as to further dewater the web. The Fourdrinier wire 3 is thereafter subjected to a cleansing operation by means (not shown) which are well known in the art and is directed about Fourdrinier wire return rolls 8, 9, 10 and 11 back to the forming roll 5. After passing the pickup shoe 14 and compressible fluid nozzle 13, the fibrous web 2 remains in contact with the drying/imprinting fabric 4, passing about a direction changing roll 15 to a hot air thermal dryer depicted schematically at 16 and 17 and described in detail in U.S. Pat. No. 3,303,576 issued to Sisson on Feb. 14, 1967, said patent being hereby incorporated herein by reference. The moist paper web is preferably thermally predried to a fiber consistency of at least about 30 percent, and most preferably to a fiber consistency between about 30 percent and about 98 percent. The drying/imprinting fabric and the thermally predried paper web then pass over a straightening roll 18 which prevents the formation of wrinkles in the imprinting fabric, over another drying-/imprinting fabric return roll 19 onto the non-yielding surface of a Yankee dryer drum 37. The knuckles of the drying/imprinting fabric 4 are impressed into the thermally predried paper web 2 by a non-yielding pressure roll 20. The drying/imprinting fabric 4 thereafter passes over direction changing roll 21, is washed free of clinging fibers by water sprays 22 and 23, passes over another direction changing roll 24, is dried by means of a vacuum box 25, and thereafter passes about direction changing rolls 26, 27, 28, 29, 30, 31, 32, 33, 34, and 35 to the twin wire forming roll 5. The impressed paper sheet 2 continues from the impression nip roll 20 along the periphery of the Yankee dryer drum 37 for final drying and is desirably creped from the Yankee dryer surface by means of a doctor blade 38. If desired, the surface of the Yankee dryer can be sprayed with a small amount of adhesive solution from the spray nozzle 36 to improve the bond between the knuckle imprints of the paper sheet and the Yankee dryer surface during drying.

Figure 2:
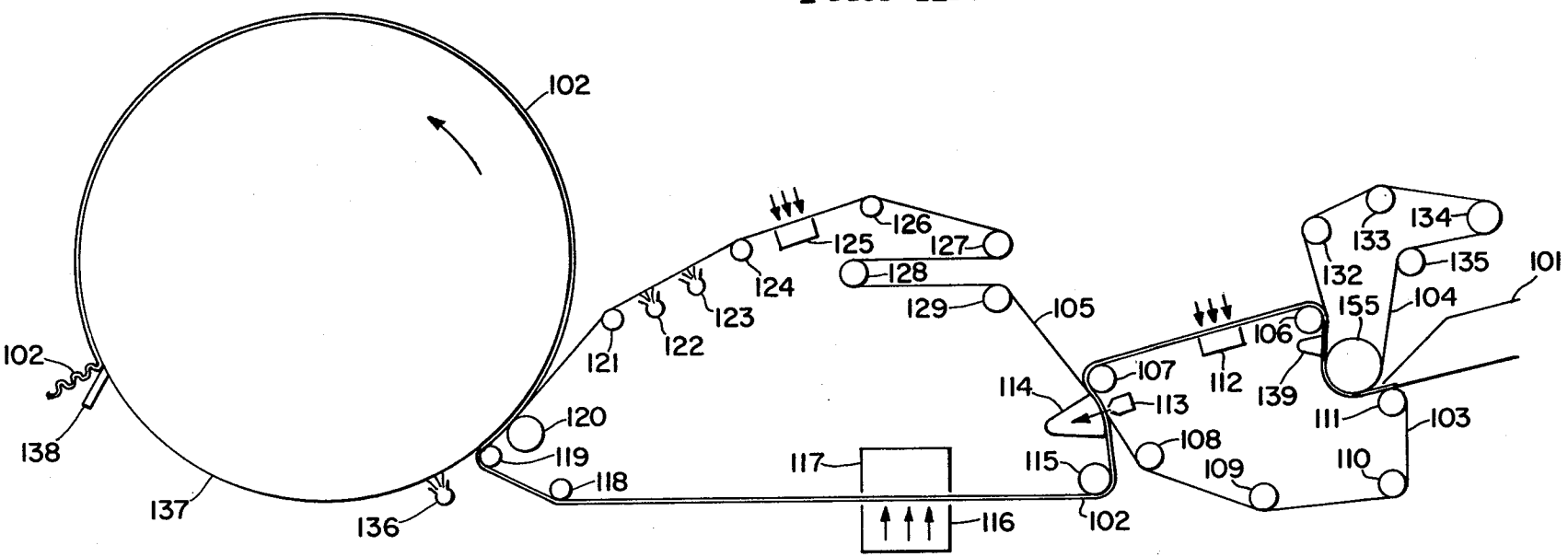
Fig. 2 Prior Art
FIG. 2 is a simplified schematic illustration of a prior art style twin wire forming machine utilized in conjunction with a low-density papermaking process such as that disclosed in the aforementioned patent to Sanford et al.

FIG. 2 depicts a typical prior art twin wire formation style papermachine utilized in conjunction with a low-density papermaking process such as that disclosed in the aforementioned patent to Sanford et al. A papermaking furnish is delivered from a closed headbox 101 intermediate a lowermost Fourdrinier wire 103 and an uppermost Fourdrinier wire 104 which converge with one another to form a nip about forming roll 105. Upon exit from the forming zone of the forming roll 155, the laminate sandwich comprising the two Fourdrinier wires and the moist fibrous web passes over a vacuum box 139 which removes water from the sandwich and draws the moist fibrous web 102 into more intimate engagement with the lowermost Fourdrinier wire 103. The laminate sandwich thereafter passes over a rubber covered separation roll 106 where the uppermost Fourdrinier wire 104 is separated from the moist paper web which remains with the lowermost Fourdrinier wire 103. The uppermost Fourdrinier wire 104 passes about direction changing rolls 132, 133, 134 and 135 and after suitable cleansing (not shown) returns to the forming roll 155.

The moist fibrous web 102 and the lowermost Fourdrinier wire 103 are directed across a vacuum box 112 which serves to further dewater the web and about rubber covered couch roll 107 which brings the outermost surface of the moist fibrous web into direct contact with a drying/imprinting fabric 105 of the type generally described in the aforementioned patents to Sanford et al. and to Morgan, Jr. et al. The moist fibrous web is thereafter subjected to a fluid pressure differential while constrained between the lowermost Fourdrinier wire 103 and the less dense drying/imprinting fabric 105. In the embodiment shown in FIG. 2, this comprises a vacuum pickup shoe 114 preferably operating in conjunction with a compressible fluid nozzle 113 extending across the entire width of the web. In addition to providing a web dewatering effect, the jet aids in molding the web into the interstices of the less dense drying/imprinting fabric 105 and in separating the moist paper web from the Fourdrinier wire 103. The Fourdrinier wire 103 is thereafter separated from the moist paper web 102 and after suitable cleansing (not shown) returns to the forming roll 155 about direction changing rolls 108, 109, 110 and 111. The moist fibrous web 102 is thereafter processed in substantially the same manner as the moist fibrous web 2 described in connection with FIG. 1, i.e., it is transported about direction changing roll 115 on the drying/imprinting fabric 105, it is thermally predried by means of a hot air blowthrough dryer illustrated schematically at 116 and 117, it is transported about fabric straightening roll 118 and fabric return roll 119, the knuckles of the drying/imprinting fabric 105 are impressed into its surface by means of pressure roll 120 operating against the surface of a Yankee dryer 137, it is finally dried on the surface of the Yankee dryer and thereafter removed by means of a doctor blade 138 to provide a finished creped paper structure. The surface of the Yankee dryer is preferably sprayed with a small amount of adhesive solution from spray nozzle 136 to improve the bonds between the knuckle imprints of the paper sheet and the Yankee dryer surface during drying. The drying/imprinting fabric 105, after separation from the thermally predried paper web, is preferably washed by means of water sprays 122 and 123 located intermediate direction changing rolls 121 and 124, dried by means of vacuum box 125, passed about a series of direction changing rolls 126, 127, 128 and 129, and returned to the vacuum pickup shoe 114.

It is well known in the papermaking art that a moist fibrous web has a natural tendency to readily transfer from a rough surface to a smoother surface. This natural tendency of the moist fibrous web 102 to stay in contact with the more dense, i.e., less open, Fourdrinier wire 103 must, however, be overcome when the web is transferred to the drying/imprinting fabric 105 which is considerably less dense, i.e., has greater open interstitial area, then the Fourdrinier wire by means of a fluid pressure differential applied across the surface of the web. This has typically been accomplished by means of a vacuum pickup shoe 114 preferably operating in conjunction with a compressible fluid nozzle 113 extending across the entire width of the web.

The need to overcome the aforementioned natural tendency of a moist fibrous web to effect a complete transfer from a rough surface to a smoother surface is, however, substantially reduced in the practice of the present invention as embodied in FIG. 1. By extending the drying/imprinting fabric all the way to the formation zone of twin wire forming roll 5, the fibrous web 2 is actually molded while at extremely low fiber consistency into the interstices of the lowermost Fourdrinier wire 3 and to a much greater extent into the interstices of the less dense drying/imprinting fabric 4. Since the moist fibrous web 2 remains in contact with the drying-/imprinting fabric 4 throughout the thermal predrying and imprinting operations in the embodiment illustrated in FIG. 1, the deflected areas formed in the surface of the web in contact with the drying/imprinting fabric remain essentially undisturbed, at least while the web is at low fiber consistency. Because intimate engagement of the moist fibrous web 2 with the drying/imprinting fabric 4 already exists at the point of separation from the lowermost Fourdrinier wire 3, a complete web transfer is not required. Rather, it is only necessary to disengage the surface of the web in contact with the Fourdrinier wire. Because the fibrous web is molded directly into the interstices of the drying/imprinting fabric 4 at extremely low consistency when the fibers are extremely mobile and also because the surface of the web contacting the drying/imprinting fabric remains undisturbed, at least through the thermal predrying stage, it has been determined that finished creped paper sheets processed in accordance with the present invention exhibit increases in caliper on the order of 20 percent prior to calendering and consequently a lower overall density for a given basis weight. This improvement is further reflected in terms of improved absorptive capacity in the resulting finished product.

In order to demonstrate that the improved bulk and absorptive capacity characteristics referred to above are due to the elimination of the independent uppermost Fourdrinier wire and extension of the drying/imprinting fabric rather than to the use of a less dense, i.e., more open, uppermost foraminous surface in the formation zone, experiments were conducted to compare paper samples produced generally in accordance with the illustrated embodiments. The results of the experiments are graphically illustrated in FIG. 3.

Figure 3:
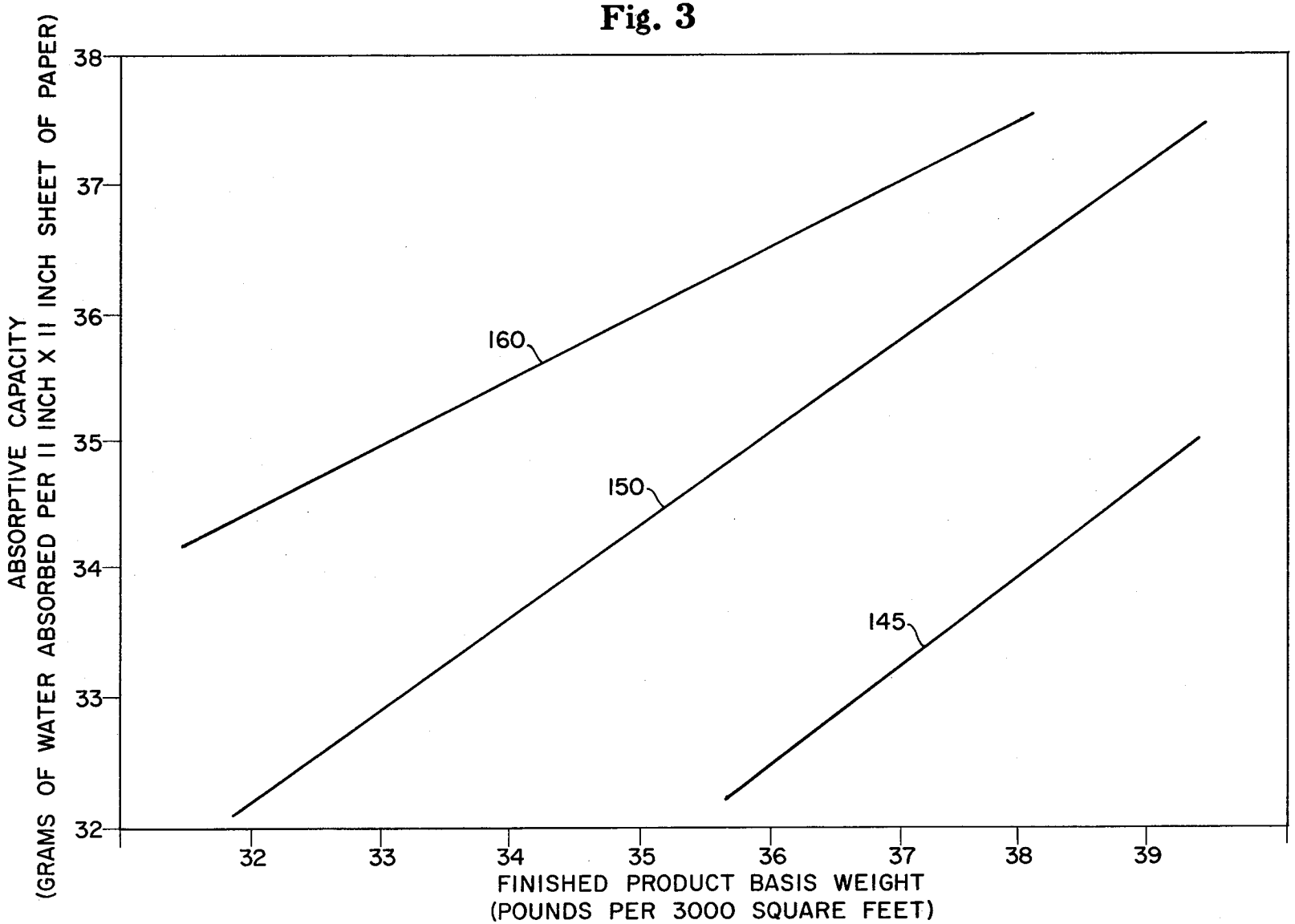
FIG. 3 is a graph comparing the absorptive capacity of paper sheets produced by a process such as that illustrated in FIG. 1 with those produced by a prior art process such as that illustrated in FIG. 2.

FIG. 3 depicts the relation between absorptive capacity and finished product basis weight for the alternative processing systems shown in FIGS. 1 and 2. Each of the lines 145, 150 and 160 illustrated in FIG. 3 is based on a minimum of ten data points. Absorptive capacity, as utilized in FIG. 3, represents the grams of water absorbed per 11 inch by 11 inch creped sheet of dry paper sample.

All finished sheets employed to generate data for FIG. 3 were prepared utilizing, at least to the extent feasible, similar processing conditions. The finished sheets exhibited approximately 25 percent crepe and were calendered to a substantially uniform caliper of approximately 26 mils, as measured under a load of 80 grams per square inch, to permit winding a uniform number of sheets on a given diameter core.

Absorptive capacity values were obtained utilizing 11 inch × 11 inch sample sheets, and immersing them in water for a period of 30 seconds. Half of the samples thus moistened were thereafter allowed to drain by supporting them in a horizontal position for 120 seconds, then vertically in the machine direction for 60 seconds, and finally weighed. The process was repeated for the balance of the sheets, the only difference being that the sheets were supported vertically in the cross-machine direction. An average of the machine direction and the cross-machine direction values so obtained is reported in FIG. 3.

Line 145 in FIG. 3 is comprised of data taken from a papermaking machine of the type generally illustrated in FIG. 2 employing a 78 machine direction × 60 cross-machine direction four-shed satin weave lowermost Fourdrinier wire 103 comprised of plastic monofilament wires having a diameter of approximately 0.008 inches, an identical uppermost Fourdrinier wire 104, and a 31 machine direction × 25 cross-machine direction semi-twill weave drying/imprinting fabric 105 comprised of plastic monofilaments having a diameter of approximately 0.020 inches. The 31 × 25 semi-twill fabric was prepared and utilized in accordance with the procedures generally described in U.S. Pat. No. 3,905,863 issued to Ayers on Sept. 16, 1975, said patent being hereby incorporated herein by reference. Line 150 in FIG. 3 represents data collected from a papermaking run employing the same basic configuration illustrated in FIG. 2, but substituting a 24 machine direction × 20 cross-machine direction semi-twill weave drying/imprinting fabric, as generally described in the aforementioned patent to Ayers, comprised of plastic monofilaments having a diameter of approximately 0.024 inches for the uppermost Fourdrinier wire 104 utilized in connection with the papermachine runs during which data for line 145 was generated. A comparison of lines 145 and 150 clearly demonstrate that a less dense, i.e., more open, uppermost forming surface 104 produces benefits in absorptive capacity. Line 160, however, clearly illustrates the additional benefit provided by practice of the present invention. The data comprising line 160 represent a papermachine configuration such as is illustrated in FIG. 1 wherein a 78 machine direction 33 60 cross-machine direction four-shed satin weave lowermost Fourdrinier wire 3 comprised of plastic monofilament wires having a diameter of approximately 0.008 inches is employed in combination with a 31 machine direction × 25 cross-machine direction semi-twill weave drying/imprinting fabric 4, as generally described in the aforementioned patent to Ayers, comprised of plastic monofilaments having a diameter of approximately 0.020 inches extended all the way back to the formation zone of the forming roll 5. A comparison of lines 150 and 160 clearly demonstrate that elimination of the independent uppermost Fourdrinier wire 104 and consequently the need for a complete web transfer to the drying/imprinting fabric at the vacuum pickup shoe are far more significant contributors to finished product absorptive capacity than mere replacement of the uppermost Fourdrinier wire 104 with a less dense, i.e., more open structured, forming surface.

It is thus apparent that the present invention provides improved method and apparatus for producing a soft, bulky and absorbent paper sheet exhibiting unexpected, but significant, improvements in finished product bulk and absorptive capacity over known prior art techniques.

It is to be understood that the forms of the invention herein illustrated and described are to be taken as preferred embodiments. Various modifications will be apparent to those skilled in the art.

Having thus defined and described the invention, what is claimed is:

1. A low-density papermaking process for the manufacture of a soft, bulky and absorbent paper sheet having a basis weight between about 5 and about 40 pounds per 3,000 square feet, as measured in an uncreped state, comprising the steps of:

(a) forming a moist paper web directly between a first traveling foraminous support member and a second traveling foraminous support member comprised of filaments which form knuckles at their points of intersection and having more open interstitial area than said first foraminous support member, said second foraminous support member having between about 100 and about 3,600 mesh openings per square inch;

(b) subjecting said moist paper web to a fluid pressure differential while said web is constrained between said first traveling foraminous support member and said second traveling foraminous support member while said web is at a fiber consistency sufficiently low to permit partially displacing at least one surface of said web in small discrete deflected areas corresponding to the mesh openings in said second foraminous support member; and (c) drying said web to a fiber consistency of at least about 30 percent without disturbing the deflected areas in said web.

2. The method of claim 1, wherein said first traveling foraminous support member comprises a Fourdrinier wire and said second traveling foraminous support member comprises a drying/imprinting fabric.

3. The method of claim 1, including the step of separating said first traveling foraminous support member from said paper web and said second traveling foraminous support member after said web has been subjected to said fluid pressure differential, said web remaining in contact with said second traveling foraminous support member.

4. The method of claim 3, wherein said web is thermally predried to a fiber consistency between about 30 percent and about 98 percent while said web is supported on said second traveling foraminous support member.

5. The method of claim 4, including the step of impressing the knuckles of said second traveling foraminous support member into said web by passing said second support member and said web through a nip formed between a pressure roll and a non-yielding surface.

6. The method of claim 5 wherein said non-yielding surface comprises a Yankee dryer drum and said method includes the steps of adhering said paper web to the surface of said Yankee dryer drum at points corresponding to the knuckle impressions formed in said web by said second foraminous support member and thereafter finally drying said web while supported on said drum.

7. The method of claim 6, including the step of removing said web from said Yankee dryer drum by means of a creping blade.

8. The method of claim 5, wherein said web is finally dried while said web is supported on said second traveling foraminous support member.

9. The method of claim 8, including the step of mechanically micro-creping said web after removal thereof from said second traveling foraminous support member.

10. In a twin-wire papermaking machine for the manufacture of a low-density, soft, bulky and absorbent paper sheet, the combination of a first endless foraminous support member having interstices for draining paper stock deposited thereon, means for moving and supporting said support member and including a first rotatable roll about which said support member passes, a second endless foraminous support member comprised of filaments which form a knuckle pattern at their points of intersection and which is of lower density than said first foraminous support member, said second foraminous support member having between about 100 and about 3,600 mesh openings per square inch, a second rotatable roll about which said second foraminous support member moves located in proximity to said first rotatable roll, means for depositing paper stock between said rolls and thereby between said first foraminous support member and said second foraminous support member, said paper stock depositing means including a headbox, said headbox having a slice opening located between said first and second rotatable rolls and said first and second support members, a rotatable forming roll about which said first and said second foraminous support members travel thereby forming a moist paper web from the paper stock deposited therebetween, means for subjecting said moist paper web to a fluid pressure differential while constrained between said foraminous support members, thereby displacing the surface of said web in contact with said second foraminous support member into the interstices thereof, means for thereafter separating said first foraminous support member from said paper web, said web remaining with said second foraminous support member, and means for drying said web to a fiber consistency of at least about 30 percent on said second foraminous support member without disturbing the displaced areas in said web.

11. The apparatus of claim 10, wherein said first foraminous support member comprises a Fourdrinier wire and said second foraminous support member comprises a drying/imprinting fabric.

12. The apparatus of claim 10 wherein said means for drying said web on said second foraminous support member comprises a thermal predryer.

13. The apparatus of claim 12, including a pressure roll for imprinting the knuckle pattern of said second support member into said web against a non-yielding surface.

14. The apparatus of claim 13, wherein said non-yielding surface comprises a Yankee dryer.

15. The apparatus of claim 14, including a creping blade for removing said web from the surface of said Yankee dryer after final drying thereof.

* * * * *

UNITED STATES PATENT AND TRADEMARK OFFICE

CERTIFICATE OF CORRECTION

PATENT NO. : 4,102,737

DATED : July 25, 1978

INVENTOR(S) : Wendell J. Morton

It is certified that error appears in the above-identified patent and that said Letters Patent are hereby corrected as shown below:

Column 4, line 24, "105" should read -- 155 --.

Column 7, line 3, "33" should read -- x --.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*